US007004978B2

(12) United States Patent
Kando et al.

(10) Patent No.: US 7,004,978 B2
(45) Date of Patent: Feb. 28, 2006

(54) TREATMENT METHOD FOR IMPACTING PROPERTIES OF ABSORBING AND RELEASING MOISTURE TO FIBER

(75) Inventors: Yoshihiro Kando, Yao (JP); Akira Honjo, Yao (JP)

(73) Assignee: Matsumoto Yushi-Seiyaku Co., Ltd., Osaka (JP)

( * ) Notice: Subject to any disclaimer, the term of this patent is extended or adjusted under 35 U.S.C. 154(b) by 113 days.

(21) Appl. No.: 10/475,013

(22) PCT Filed: Feb. 14, 2003

(86) PCT No.: PCT/JP03/01574

§ 371 (c)(1),
(2), (4) Date: Oct. 16, 2003

(87) PCT Pub. No.: WO03/071022

PCT Pub. Date: Aug. 28, 2003

(65) Prior Publication Data

US 2004/0117917 A1 Jun. 24, 2004

(30) Foreign Application Priority Data

Feb. 19, 2002 (JP) ..... 2002-087161

(51) Int. Cl.
*D06M 14/00* (2006.01)
*D06M 15/263* (2006.01)

(52) U.S. Cl. ..... 8/192; 8/115.51; 8/115.62; 8/15.56; 8/127.6

(58) Field of Classification Search ..... 8/115.51, 8/115.62, 115.56, 127.6, 192
See application file for complete search history.

(56) References Cited

U.S. PATENT DOCUMENTS 3,619,117 A * 11/1971 Anzuino et al. ..... 8/137.5

FOREIGN PATENT DOCUMENTS

| | | | | |
|---|---|---|---|---|
| JP | 57-191315 | A | | 11/1982 |
| JP | 4-306236 | A | | 10/1992 |
| JP | 6-16952 | A | | 1/1994 |
| JP | 10-195169 | A | | 7/1998 |
| JP | 11-209550 | A | * | 8/1999 |
| JP | 2995442 | B2 | | 10/1999 |
| JP | 2000-119964 | | * | 4/2000 |
| JP | 2002-38375 | A | | 2/2002 |
| WO | WO 97/402227 | A1 | | 10/1997 |

OTHER PUBLICATIONS

English translation of JP 2000-119664 from JPO website, Apr. 2000.*
Abstract of JP 11209550 A Aug. 1999.*

* cited by examiner

*Primary Examiner*—Margaret Einsmann
(74) *Attorney, Agent, or Firm*—Birch, Stewart, Kolasch & Birch, LLP

(57) ABSTRACT

The present invention provides a fiber-treating process wherein fiber is treated, in the presence of a polymerization initiator, with a fiber-treating composition containing (A) reactive protein synthesized by chemically bonding protein with a compound having polymerizable unsaturated group(s) or (A') grafted protein which has been produced by graft-copolymerizing (C) hydrophilic monomer having vinyl group(s) onto (A) reactive protein synthesized by chemically bonding protein with a compound having polymerizable unsaturated group(s), and (B) hydrophilic monomer having vinyl group(s).

The process provides fiber imparted with moisture absorbability and releasability durable against washing, antistaticity, water absorbability, and dry hand.

8 Claims, No Drawings

TREATMENT METHOD FOR IMPACTING PROPERTIES OF ABSORBING AND RELEASING MOISTURE TO FIBER

This application is the national phase under 35 U.S.C. § 371 of PCT International Application No. PCT/JP03/01574 which has an International filing date of Feb. 13, 2003, which designated the United States of America.

FIELD OF INVENTION

The present invention relates to a fiber-treating process with a fiber-treating composition and fiber treated therewith. In detail, the present invention relates to a fiber-treating process that imparts moisture absorbability and releasability durable against washing, antistaticity, water absorbability, and dry hand to fiber; and treated fiber obtained thereby.

TECHNICAL BACKGROUND

Textile materials, especially synthetic fibers, are employed in various fields, such as apparels and industrial textiles. Among various synthetic fibers, polyester fiber and acrylic fiber are hydrophobic and have poor moisture absorbability and antistaticity. Garments and bedclothes produced with such hydrophobic fibers give very uncomfortable sticky feel to wearers in a sweat, in other words, deteriorate the comfortableness of wearers. This has been the disadvantage of those fibers comparing to natural fibers. For solving such problem, JP-A 2002-38375 (the term "JP-A" as used herein means an "unexamined published Japanese patent application") proposed a process wherein hydrophobic synthetic fiber is modified to be hydrophilic by graft-copolymerizing such synthetic fiber with water-absorptive organic fine particles comprising of carboxylate radicals and cross-linked acrylic polymer; and JP-A 6-16952 proposed a process wherein hydrophobic synthetic fiber is modified by imparting the moisture absorbability of natural substances to synthetic fiber through adding natural substances in fiber-forming polymer or fixing natural substances or amide-modified proteins onto synthetic fiber with the aid of resin binders. However, those processes required complex and numerous processing steps and high cost, and the synthetic fiber treated with resin binders exhibited uncomfortable hand. Japanese Patent 2995442 proposed a process wherein film of fibroin and graft-copolymer is formed on fiber surface. The film formed in this process is not durable due to the insufficient number of sites of reaction between fibroin and graft-copolymer.

DISCLOSURE OF INVENTION

The object of the present invention is to provide simple industrial fiber-treating process that solves the above-mentioned problems and imparts moisture absorbability and releasability durable against washing, antistaticity, water absorbability and dry hand to fiber with low cost and no environmental pollution.

Another object of the present invention is to provide fiber treated with the process of the present invention to which the above-mentioned properties are imparted.

Further object and advantage of the present invention are precisely described as follows.

First, the object and the advantage of the present invention mentioned above are fulfilled by the fiber-treating process wherein fiber is treated, in the presence of a polymerization initiator, with a fiber-treating composition containing (A) reactive protein synthesized by chemically bonding protein with a compound having polymerizable unsaturated group(s) and (B) hydrophilic monomer having vinyl group(s).

Second, the object and the advantage of the present invention mentioned above are further fulfilled by the fiber-treating process wherein fiber is treated, in the presence of a polymerization initiator, with a fiber-treating composition containing (A') grafted protein produced by graft-copolymerizing (C) hydrophilic monomer having a vinyl group(s) onto (A) reactive protein synthesized by chemically bonding protein with a compound having polymerizable unsaturated group(s), and (B) hydrophilic monomer having vinyl group(s).

Third, the object and the advantage of the present invention mentioned above are also fulfilled by the fiber treated in the process of the present invention described above.

BEST MODE OF EMBODIMENT

The fiber variants to be treated in the process of the present invention are, for example, polyaramid fiber, polyester fiber, nylon fiber, polyolefin fiber, urethane fiber, rayon fiber, cotton and wool.

Those fiber variants can be treated in the process either in single or in blend. The form of fiber to be treated includes tow, web, yarn strands, woven or knit fabric, tufted fabric, nonwovens and pieces. Among those, tufted fabric of natural and/or synthetic fiber is preferable.

The proteins employed in the present invention are, for example, collagen, gelatin, sericin, fibroin, keratin, and hydrolizates and derivatives thereof. Artificially synthesized polypeptide can be employed similarly. The preferable proteins are collagen, gelatin, sericin and their hydrolizates. Those proteins can be applied in the present invention in single or in a combination of two or more.

The preferable average molecular weight (M.W.) of those proteins ranges from 1,000 to 5,000. Proteins having a molecular weight less than 1,000 cannot attain sufficient property on treated fiber, and those having a molecular weight more than 5,000 cannot be bonded with polymerizable unsaturated group(s) or are apt to cause very uncomfortable hand to fiber.

The reactive protein (A) employed in the present invention is produced by chemically bonding protein with a compound having polymerizable unsaturated group(s). Isocyanates having polymerizable unsaturated group(s) are the example of preferable compounds. Examples of such isocyanates include 2-methacryloyl oxyethylene isocyanate and methacryloyl isocyanate.

The reactive protein (A) can be preferably produced by reacting protein and isocyanates having polymerizable unsaturated group(s) in a state of aqueous solution having a pH value of 5 to 13. Specifically, the process for performing the reaction is disclosed in JP-A 10-195169. The ratios of protein and an isocyanate having polymerizable unsaturated group(s) can be selected optionally. For attaining the purpose of the present invention, that is, improved durability of the fiber properties against washing, a preferable quantity of an isocyanate having polymerizable unsaturated group(s) is such that with which all of the functional groups of protein are saturated. An excessive quantity of an isocyanate having polymerizable unsaturated group(s) for saturating the functional groups of protein is not preferable, because the isocyanate remained in a fiber-treating solution adversely affects on the stability of the solution. An example of the aqueous solution of reactive gelatin is prepared by dissolving gelatin in water and an organic solvent in a 1-liter reactor equipped with a thermometer, reflux condenser and agitator, adding 2-methacryloyl oxyethylene isocyanate or methacryloyl isocyanate with agitation at 3,000 rpm, and reacting the isocyanate with gelatin to chemically bond the isocyanate to the gelatin.

The grafted protein (A') of the present invention can be produced by graft-copolymerizing (C) hydrophilic monomer having vinyl group(s) onto (A) the above-mentioned reactive protein. The graft-copolymerization can be attained in solution polymerization with a polymerizing initiator wherein radicals are generated. Specifically, the grafted protein is produced by dissolving (A) the reactive protein and (C) a hydrophilic monomer having vynil group(s) in a 1-liter reactor equipped with a thermometer, reflux condenser and agitator, adding a polymerizing initiator and reacting those components. The weight ratio of (A) the reactive protein and (C) a hydrophilic monomer having vinyl group(s) is selected optionally. The preferable weight ratio of (A) the reactive protein and (C) a hydrophilic monomer having vinyl group(s) is 1.0:0.1 to 1.0:1.0. A weight ratio below 0.1 of a hydrophilic monomer having vinyl group(s) cannot attain sufficient graft-copolymerization and a weight ratio above 1.0 of the hydrophilic monomer will impart excessive and nondurable hydrophilicity to fiber surface.

The hydrophilic monomers (B) and (C) having vinyl group(s) that are employed in the present invention are selected among ethylene glycol dimethacrylate, polyethylene glycol dimethacrylate, ethylene glycol diacrylate, polyethylene glycol diacrylate, 1,6-hexanediol diacrylate, 2-hydroxyethyl methacrylate, 2-hydroxyethyl acrylate, glycerin dimethacrylate, glycerin trimethacrylate, glycerin diacrylate, trimethylol propane triacrylate, trimethylol propane dimethacrylate, trimethylol propane trimethacrylate, and trimethylol propane diacrylate. Preferable monomers among those are polyethylene glycol dimethacrylate, polyethylene glycol diacrylate, 2-hydroxyethyl methacrylate and 2-hydroxyethyl acrylate, and polyethylene glycol dimethacrylate and polyethylene glycol diacrylate in which 2 to 40 moles of ethylene glycol (hereinafter referred as EG) are added are more preferable. Those monomers containing vinyl group(s) can be employed either in single or in a combination of two or more monomers.

The hydrophilic monomers (B) and (C) having vinyl group(s) may be the same or different. Preferable monomers employed as (B) are those having at least two radically polymerizable double bonds in the molecule, and polyethylene glycol dimethacrylate and polyethylene glycol diacrylate are more preferable. Preferable monomers employed as (C) are 2-hydroxyethyl methacrylate and 2-hydroxyethyl acrylate.

The polymerizing initiators employed in the present invention are peroxides, such as potassium persulfate, ammonium persulfate, hydrogen peroxide and benzoyl peroxide; ammonium ceric salts, such as ammonium ceric sulfate and ammonium ceric nitrate; α,α-azobisisobutylonitrile, and 2,2'-azobis(2-aminodipropane) dihydrochloride. Those initiators can be applied either in single or in a combination of two or more.

The fiber-treating composition of the present invention can be applied to fiber with known methods, such as spraying, padding, immersion and coating. In the application with padding, fiber or fiber products are immersed in the above-mentioned fiber-treating composition, squeezed with a mangle, dried at about 100° C., and cured at 110 to 170° C. for 1 to 2 minutes.

Softeners can also be applied in the process of the present invention if necessary and applicable softeners are those containing aliphatic compounds or silicones. For attaining sufficient moisture absorbability of fiber, water-absorbable softeners, such as ZONTES GS-5, produced by Matsumoto Yushi-Seiyaku Co., Ltd., are preferablly applied in combination.

EXAMPLES

The present invention is further described with the following examples though the present invention is not restricted within the scope of those examples.

The fiber-treating process, moisture absorbability and releasability, antistaticity, water absorbability and durability against washing tested in the present invention are described below. The part and percent mentioned in the examples are part by weight and percent by weight. The moisture absorbability and releasability, antistaticity, water absorbability, and durability against washing were tested as described below. The results of the testing with acrylic knit fabric, acrylic Mayer blanket and polyester taffeta are shown in Tables 1, 2 and 3.

Moisture Absorbability and Releasability:

The weight of a sample (W0) after pre-drying at 50° C. for 2 hours followed with drying up at 105° C. for 2 hours, the weight of the same sample (W1) after conditioning at 30° C. and 80-% relative humidity for 60 minutes to its equilibrium moisture content, and the weight of the same sample (W2) after conditioning at 20° C. and 45-% relative humidity for 60 minutes to its equilibrium moisture content were calculated into moisture absorbability and moisture releasability by the following formulae.

$$\text{Moisture absorbability } (\%)=[(W1-W0)/W0]\times 100$$

$$\text{Moisture releasability } (\%)=[(W2-W0)/W0]\times 100$$

Antistaticity:

The static charge (kv) and static half life (sec) on a fabric sample electrically charged with Kanebo Frictional Electrometer EST-7, designed according to JIS L-1094, at 20° C. and 45-% relative humidity were determined. The average of the data from five pieces of a sample, each of which was tested ten times, was reported. The sample was wool fabric.

Water Absorbability:

Ten pieces of a fabric sample were tested according to JIS 1004-5.24A. The average of the data of the ten pieces was reported.

Durability Against Washing:

Each sample was washed five times according to JIS 103.

Fiber-Treating Condition:

Acrylic Knit Fabric

Fabric sample: 100-% acrylic knit fabric

Padding: two cycles of immersion and squeezing, with final wet pickup of 58%

Drying: at 100° C. for 3 minutes

Curing: at 130° C. for 1 minutes

Acrylic Raised Fabric

Fabric sample: 100-% acrylic Mayer blanket

Padding: two cycles of immersion and squeezing, with final wet pickup of 61%

Drying: at 100° C. for 3 minutes

Curing: at 130° C. for 1 minutes

After the treatment, the fabric sample was processed into Mayer blanket through raising, shearing and polishing in conventional method.

Polyester Taffeta

Fabric sample: 0.100-% polyester taffeta

Padding: two cycles of immersion and squeezing, with final wet pickup of 82%

Drying: at 100° C. for 3 minutes

Curing: at 130° C. for 1 minutes

Example of Synthesis 1

Sixty parts of gelatin, 0.6 parts of ethylene glycol monoethyl acetate, 6.0 parts of isopropyl alcohol and 240 parts of water were placed in a 3-liter reactor equipped with a thermometer, reflux condeser and agitator. The mixture was dissolved and 7.2 parts of 2-methacryloyl oxyethylene isocyanate was dropped gradually in 60 minutes with agitation at 3,000 rpm with a homomixer. Then 360 parts of water was added to the solution and an aqueous solution of reactive gelatin was prepared.

Example of Synthesis 2

One hundred parts of 2-hydroxyethyle methacrylate, 27 parts of 2,2'-azobis (2-aminodipropane) dihydrochloride, 40 parts of 90-% acetic acid and 1,460 parts of water were added to the aqueous solution of a reactive gelatin described in Example of synthesis 1. The mixture was reacted at 70° C. for 6 hours with nitrogen blanket to be prepared into an aqueous solution of grafted gelatin.

Example of Synthesis 3

Sixty parts of collagen, 0.6 parts of ethylene glycol monoethyl acetate, 6.0 parts of isopropyl alcohol and 240 parts of water are placed in a 3-liter reactor equipped with a thermometer, reflux condeser and agitator. The mixture was dissolved and 7.2 parts of 2-methacryloyl oxyethylene isocyanate was dropped gradually in 60 minutes with agitation at 3,000 rpm with a homomixer. Then 360 parts of water was added to the solution and an aqueous solution of reactive collagen was prepared.

Example of Synthesis 4

One hundred parts of 2-hydroxyethyl methacrylate, 27 parts of 2,2'-azobis (2-amidinopropane) dihydrochloride, 40 parts of 90-% acetic acid and 1,460 parts of water were added to the aqueous solution of a reactive collagen in Example of synthesis 3. The mixture was reacted at 70° C. for 6 hours with nitrogen blanket to be prepared into an aqueous solution of grafted collagen.

Comparative Example of Synthesis 1

Sixty parts of gelatin, 0.6 parts of ethylene glycol monoethyl acetate, 6.0 parts of isopropyl alcohol and 600 parts of water are placed in a 3-liter reactor equipped with a thermometer, reflux condeser and agitator. The mixture was dissolved into an aqueous solution of gelatin.

Comparative Example of Synthesis 2

Sixty parts of collagen, 0.6 parts of ethylene glycol monoethyl acetate, 6.0 parts of isopropyl alcohol and 600 parts of water are placed in a 3-liter reactor equipped with a thermometer, reflux condeser and agitator. The mixture was dissolved into an aqueous solution of collagen.

Example 1

| | |
|---|---|
| Aqueous solution of reactive gelatin (of Example of synthesis 1) | 20.0% |
| Polyethylene glycol dimethacrylate (9-mol-EG adduct) | 0.5% |
| Ammonium persulfate | 0.3% |

Example 2

| | |
|---|---|
| Aqueous solution of reactive gelatin (of Example of synthesis 1) | 20.0% |
| Polyethylene glycol dimethacrylate (9-mol-EG adduct) | 0.5% |
| Ammonium persulfate | 0.3% |
| ZONTES GS-5 (produced by Matsumoto Yushi-Seiyaku Co., Ltd.) | 7.0% |

Example 3

| | |
|---|---|
| Aqueous solution of grafted gelatin (of Example of synthesis 2) | 20.0% |
| Polyethylene glycol dimethacrylate (9-mol EG-adduct) | 0.5% |
| Ammonium persulfate | 0.3% |

Example 4

| | |
|---|---|
| Aqueous solution of grafted gelatin (of Example of synthesis 2) | 20.0% |
| Polyethylene glycol dimethacrylate (9-mol-EG adduct) | 0.5% |
| Ammonium persulfate | 0.3% |
| ZONTES GS-5 (produced by Matsumoto Yushi-Seiyaku Co., Ltd.) | 7.0% |

Example 5

| | |
|---|---|
| Aqueous solution of reactive collagen (of Example of synthesis 3) | 20.0% |
| Polyethylene glycol dimethacrylate (9-mol-EG adduct) | 0.5% |
| Ammonium persulfate | 0.3% |

Example 6

| | |
|---|---|
| Aqueous solution of grafted collagen (of Example of synthesis 4) | 20.0% |
| Polyethylene glycol dimethacrylate (9-mol-EG adduct) | 0.5% |
| Ammonium persulfate | 0.3% |

Comparative Example 1

Treating with Water

Comparative Example 2

| | |
|---|---|
| Aqueous solution of gelatin (Comparative example of synthesis 1) | 20.0% |

Comparative Example 3

| | |
|---|---|
| Aqueous solution of collagen (Comparative example of synthesis 2) | 20.0% |

Comparative Example 4

| | |
|---|---|
| ZONTES GS-5 (produced by Matsumoto Yushi-Seiyaku Co., Ltd.) | 20.0% |

Comparative Example 5

| | |
|---|---|
| Aqueous solution of collagen (Comparative example of synthesis 2) | 20.0% |
| Polyethylene glycol dimethacrylate (9-mol-EG adduct) | 0.5% |
| Ammonium persulfate | 0.3% |

TABLE 1

100-% acrylic knit fabric

| Test No. | before or after washing | Moisture absorbability (%) | Moisture releasability (%) | Static charge (kV) | Static half life (sec) | Water absorbability (sec) |
|---|---|---|---|---|---|---|
| Example 1 | before | 2.4 | 1.0 | +0.16 | 0.6 | immediate |
| | after | 1.7 | 1.3 | −0.18 | 2.5 | immediate |
| Example 2 | before | 2.2 | 1.2 | +0.36 | 0.3 | immediate |
| | after | 1.6 | 1.2 | −0.48 | 3.2 | immediate |
| Example 3 | before | 2.1 | 1.0 | +0.24 | 0.3 | immediate |
| | after | 1.6 | 1.1 | −0.42 | 2.2 | immediate |
| Example 4 | before | 2.0 | 1.1 | +0.18 | 0.5 | immediate |
| | after | 1.8 | 1.0 | −0.28 | 1.3 | immediate |
| Example 5 | before | 2.2 | 0.9 | +0.26 | 0.6 | immediate |
| | after | 1.9 | 1.1 | −0.08 | 1.8 | immediate |
| Example 6 | before | 2.2 | 1.2 | +0.14 | 0.2 | immediate |
| | after | 2.0 | 1.1 | −0.39 | 1.1 | immediate |
| Comparative | before | 1.1 | 1.0 | −3.72 | 60< | immediate |
| example 1 | after | 1.1 | 0.9 | −5.12 | 60< | 60< |
| Comparative | before | 2.1 | 1.2 | −0.21 | 0.3 | immediate |
| example 2 | after | 0.9 | 1.1 | −4.44 | 60< | 60< |
| Comparative | before | 2.0 | 0.9 | −0.35 | 0.5 | immediate |
| example 3 | after | 1.0 | 1.2 | −5.12 | 60< | 60< |
| Comparative | before | 1.5 | 1.0 | −3.41 | 12.4 | 5.2 |
| example 4 | after | 1.1 | 1.0 | −4.11 | 60< | 60< |
| Comparative | before | 0.9 | 1.1 | −0.19 | 0.9 | immediate |
| example 5 | after | 1.0 | 1.2 | −5.56 | 60< | 60< |

TABLE 2

100-% acrylic raised fabric

| Test No. | before or after washing | Moisture absorbability (%) | Moisture releasability (%) | Static charge (kV) | Static half life (sec) | Water absorbability (sec) |
|---|---|---|---|---|---|---|
| Example 1 | before | 2.2 | 0.9 | +0.24 | 1.0 | immediate |
| | after | 1.8 | 1.4 | −0.20 | 2.7 | immediate |
| Example 2 | before | 2.7 | 1.1 | +0.47 | 0.0 | immediate |
| | after | 1.4 | 1.0 | −0.61 | 4.1 | immediate |
| Example 3 | before | 2.3 | 0.9 | +0.27 | 0.5 | immediate |
| | after | 1.8 | 0.9 | −0.57 | 2.0 | immediate |
| Example 4 | before | 2.2 | 1.0 | +0.20 | 0.7 | immediate |
| | after | 2.0 | 0.9 | −0.26 | 1.2 | immediate |

TABLE 2-continued

| Test No. | before or after washing | Moisture absorbability (%) | Moisture releasability (%) | Static charge (kV) | Static half life (sec) | Water absorbability (sec) |
|---|---|---|---|---|---|---|
| | | 100-% acrylic raised fabric | | | | |
| Example 5 | before | 2.5 | 1.0 | +0.27 | 0.7 | immediate |
| | after | 2.0 | 1.0 | −0.12 | 1.4 | immediate |
| Example 6 | before | 2.2 | 0.9 | +0.15 | 0.3 | immediate |
| | after | 1.9 | 1.0 | −0.43 | 1.0 | immediate |
| Comparative | before | 1.0 | 1.1 | −3.33 | 60< | immediate |
| example 1 | after | 1.0 | 1.0 | −4.87 | 60< | 60< |
| Comparative | before | 2.2 | 1.4 | −0.29 | 0.7 | immediate |
| example 2 | after | 1.1 | 1.0 | −5.67 | 60< | 60< |
| Comparative | before | 1.9 | 1.0 | −0.90 | 0.3 | immediate |
| example 3 | after | 0.8 | 1.1 | −6.04 | 60< | 60< |
| Comparative | before | 1.7 | 0.9 | −4.71 | 11.2 | 4.1 |
| example 4 | after | 0.9 | 1.4 | −5.27 | 60< | 60< |
| Comparative | before | 1.8 | 0.8 | −1.01 | 0.2 | immediate |
| example 5 | after | 1.1 | 1.0 | −5.14 | 60< | 60< |

TABLE 3

| Test No. | before or after washing | Moisture absorbability (%) | Moisture releasability (%) | Static charge (kV) | Static half life (sec) | Water absorbability (sec) |
|---|---|---|---|---|---|---|
| | | 100-% polyester taffeta | | | | |
| Example 1 | before | 1.6 | 0.5 | −0.24 | 1.2 | immediate |
| | after | 1.4 | 0.4 | −0.67 | 1.7 | 2.0 |
| Example 2 | before | 1.7 | 0.5 | −0.14 | 1.9 | immediate |
| | after | 1.5 | 0.6 | −0.79 | 1.5 | 1.0 |
| Example 3 | before | 1.7 | 0.4 | −0.37 | 1.1 | immediate |
| | after | 1.6 | 0.5 | −0.50 | 1.8 | 2.7 |
| Example 4 | before | 1.6 | 0.7 | −0.36 | 1.1 | immediate |
| | after | 1.4 | 0.6 | −0.79 | 1.9 | 1.8 |
| Example 5 | before | 1.7 | 0.6 | −0.45 | 1.5 | immediate |
| | after | 1.5 | 0.5 | −0.55 | 2.0 | 1.4 |
| Example 6 | before | 1.7 | 0.5 | −0.42 | 1.3 | immediate |
| | after | 1.6 | 0.4 | −0.56 | 1.7 | 1.7 |
| Comparative | before | 0.5 | 0.4 | −3.73 | 60< | 39.9 |
| example 1 | after | 0.5 | 0.5 | −0.36 | 60< | 32.1 |
| Comparative | before | 1.5 | 0.3 | −0.21 | 1.3 | 2.3 |
| example 2 | after | 0.6 | 0.5 | −2.92 | 60< | 37.1 |
| Comparative | before | 1.5 | 0.7 | −0.29 | 1.9 | 2.1 |
| example 3 | after | 0.7 | 0.5 | −3.11 | 60< | 36.6 |
| Comparative | before | 1.4 | 0.5 | −0.30 | 1.8 | 1.9 |
| example 4 | after | 0.6 | 0.5 | −3.50 | 60< | 35.2 |
| Comparative | before | 1.2 | 0.4 | −0.27 | 1.6 | 3.3 |
| example 5 | after | 0.6 | 0.6 | −2.52 | 60< | 40.1 |

The above-mentioned results prove that the fiber-treating process and fiber-treating composition of the present invention impart moisture absorbability and releasability durable against washing, antistaticity, water absorbability and dry hand to fiber without adverse effect on preferable fiber hand. The fibers imparted with the moisture absorbability and moisture releasability of the present invention are useful for the textile products, such as sportswear, underwear, lining, blankets, sheets, nightclothes and socks.

The invention claimed is:

1. A fiber-treating process, which comprises treating fiber with a fiber-treating composition containing (A) reactive protein synthesized by chemically bonding protein with isocyanates having polymerizable unsaturated group(s) and (B) hydrophilic monomer having vinyl group(s), in the presence of a polymerization initiator, wherein said protein has an average molecular weight in the range of 1000 to 5000.

2. The process of claim 1, wherein (B) hydrophilic monomer having vinyl group(s) has at least two radically polymerizable double bonds in the molecule.

3. The process of claim 1, wherein (B) hydrophilic monomer having vinyl group(s) is polyethylene glycol dimethacrylate or polyethylene glycol diacrylate.

4. A fiber-treating process, which comprises treating fiber, in the presence of a polymerization initiator with a fiber-treating composition containing (A') grafted protein which has been produced by graft-copolymerizing (C) hydrophilic monomer having vinyl group(s) onto (A) reactive protein synthesized by chemically bonding protein with isocyanates having polymerizable unsaturated group(s), and (B) hydrophilic monomer having vinyl group(s), and wherein said protein has an average molecular weight in the range of 1000 to 5000, and the weight ratio of (A) to (C) ranges from 1:0.1 to 1:1.

5. The process of claim 4, wherein (C) hydrophilic monomer having vinyl group(s) is 2-hydroxyethyl methacrylate or 2-hydroxyethyl acrylate.

6. The process of claim 1 or 4, wherein the protein is low-molecular-weight gelatin.

7. The process of claim 1 or 4, wherein the fiber to be treated is a raised fabric consisting of natural and/or synthetic fiber.

8. Fiber obtained by the process of claim 1 or 4.

* * * * *